US010759217B2

(12) United States Patent
Black et al.

(10) Patent No.: US 10,759,217 B2
(45) Date of Patent: Sep. 1, 2020

(54) UTILITY MARKER HOLSTER

(71) Applicants: Robert Black, Monroe, NY (US); James Wickstead, Mendham, NJ (US)

(72) Inventors: Robert Black, Monroe, NY (US); James Wickstead, Mendham, NJ (US)

( * ) Notice: Subject to any disclaimer, the term of this patent is extended or adjusted under 35 U.S.C. 154(b) by 0 days.

(21) Appl. No.: 16/403,528

(22) Filed: May 4, 2019

(65) Prior Publication Data

US 2019/0337324 A1 Nov. 7, 2019

Related U.S. Application Data

(60) Provisional application No. 62/666,924, filed on May 4, 2018.

(51) Int. Cl.

*B43K 25/02* (2006.01)
*A45F 5/02* (2006.01)
*B43K 23/00* (2006.01)

(52) U.S. Cl.

CPC ..... *B43K 25/02* (2013.01); *A45F 5/02* (2013.01); *B43K 23/001* (2013.01)

(58) Field of Classification Search

CPC ..... A45F 5/022; A45F 2200/0566; B43K 23/001; Y10T 24/1321

See application file for complete search history.

(56) References Cited

U.S. PATENT DOCUMENTS 4,189,048 A * 2/1980 Gaillard ..... A45C 11/34 206/37
4,562,923 A * 1/1986 Katada ..... A45D 40/24 132/314
4,708,273 A * 11/1987 Grant ..... A45F 5/02 220/741
4,798,310 A * 1/1989 Kasai ..... B43K 23/001 221/87
5,033,629 A * 7/1991 Caine ..... A47F 7/00 211/69.5
5,163,549 A 11/1992 Hayduchok
5,232,137 A * 8/1993 Devine ..... A45F 5/02 222/175
5,440,465 A * 8/1995 Hasness ..... A45F 5/02 362/103
6,029,872 A * 2/2000 Ellington ..... A01K 97/10 224/251
6,186,461 B1 * 2/2001 Pelaez ..... B43K 23/002 206/214
6,497,349 B1 * 12/2002 Ramirez ..... A45F 5/00 224/200
6,871,767 B2 3/2005 Perlman et al.
7,172,359 B2 * 2/2007 Mock ..... B43K 8/022 401/202
7,740,133 B2 * 6/2010 Lamas ..... A45C 11/36 206/214
8,764,331 B1 7/2014 Lubanski
9,694,622 B2 * 7/2017 Shea ..... B43K 25/022
10,624,442 B2 * 4/2020 Evans ..... A45F 5/02
2006/0076377 A1 4/2006 Moodie

* cited by examiner

*Primary Examiner* — Brian D Nash
(74) *Attorney, Agent, or Firm* — Baldini Law, LLC; Jack Baldini, Esq.

(57) ABSTRACT

This disclosure relates to a utilitarian holster for a marker making one-hand accessibility and use simple. Specifically, embodiments herein provide for a holster that can hold a variety of off-the-shelf marking pens in a manner that they will not dry out and allow for one-handed sightless insertion and withdrawal.

6 Claims, 6 Drawing Sheets

UTILITY MARKER HOLSTER

The present application claims the benefit of the prior filed U.S. Provisional Application No. 62/666,924, filed by the present inventors on May 4, 2018, which is incorporated herein by reference.

FIELD OF THE INVENTION

This disclosure relates to a utilitarian holster for a marker making one-hand accessibility and use simple. Specifically, embodiments herein provide for a holster that can hold a variety of off-the-shelf marking pens in a manner that they will not dry out and allow for one-handed sightless insertion and withdrawal.

BACKGROUND

In the trades, it is often desirable to quickly, easily, and sightlessly, have access to marking pens. Whether laying tile, cutting wood, marking locations and the like, often times it is required to have access to some sort of marking implement. Some trades workers carry a pencil behind their ear. Others carry a marking pen, such as a Sharpie®, with its cap, in their shirt pocket or back pants pocket. Some carry a marker in their tool belt. All of these and other known solutions have drawbacks.

A long felt issue in this field is that in using such markers, the removal of the cap and replacement of the cap requires two hands (or one hand and a mouth). This means that the job of measuring and marking is interrupted by the very process of using the marker. Or, the worker will insert the marker into his mouth. Pencil does not always mark well.

The present disclosure provides a holster, attachable to a variety of implements, such as a tool belt, or a regular belt, or anything regularly used by a tradesman in near proximity to the work, capable of accepting a variety of commonly used markers, keeping the markers when inserted from drying out, and allowing one-handed, sightless insertion and withdrawal to provide the tradesman with easy, one-handed use of the marker on repeated occasions.

There is a need for such a device as there have been many prior attempts to address many of the problems just discussed. For example, in U.S. Pat. No. 5,163,549, titled POCKET CONTAINER AND STAND FOR WRITING IMPLEMENTS, disclosed is, "a caddy of generally modular form for writing implements is designed with a plurality of sockets to receive and support writing implements in upright position, with the writing ends secured in closed position with the receiving socket. In one embodiment, the caddy accommodates a plurality of conventional marking pens together with their individual caps, which caps remain captive when the pens are removed."

In another example, in U.S. Pat. No. 6,871,767 titled MARKER PEN HOLDER, disclosed is, "a marker pen supporting and holding device includes a cavity for capturing a marker pen cap therein consisting of principal and auxiliary cavity portions. The principal cavity portion is provided for receiving a protective cap body and the auxiliary cavity portion is provided for guiding and captivating a marker cap pocket attachment clip. A securing pin extends through aligned device body apertures to traverse a gap between the cap body and the pocket attachment clip, thereby removably securing the cap within the device to enable one-handed marker pen handling."

In another example, in U.S. Patent Publication No. US 2006/0076377 A1, titled MARKER HOLSTER, disclosed is, "a marker holster includes an elongate tubular housing and a fastening member attached to the housing for removably securing the housing to an article. The housing has an upper end defining a marker opening and an opposed end. A generally open interior space extends between the marker opening and the opposed end for receiving a capped or uncapped marker. An inner surface of the housing defines an elongate slot and a locking chamber in communication with the elongate slot for selectively retaining the marker's cap in the housing, and thereby holding the attached marker. The marker may be removed from the retained marker cap and the holster by pulling the marker upwardly. A surrogate cap is nested in the housing proximate the opposed end for selectively receiving the uncapped marker's writing tip, and thereby clutching the marker. The marker may be removed from the holster by pulling the marker upwardly."

Finally, in another example, in U.S. Pat. No. 8,764,331, titled MARKER WITH REVERSE CLIP CAP, disclosed is, "a marker has a cap with a reverse clip, which opens toward the closed end of the cap, that is, in the same direction as the force applied to remove the cap, thereby allowing the cap to be removed with one hand without dislodging the reverse clip from its attachment. To facilitate single-handed removal and replacement of the marker, the cap has a semi-tubular cap extension, terminating in a flange from which the reverse clip extends. The cap extension acts as a guide for replacing the marker in the cap with one hand, while the flange provides a flat surface against which downward thumb pressure can be applied to separate the cap from the marker as the latter is pulled up with the other fingers of the same hand."

It is clear from the foregoing references that there remains a need in the industry for a holster for markers that allows for easy, sightless, one-handed removal and replacement to deploy and use the marker. These prior attempts each fall short for a variety of reasons.

The present disclosure teaches embodiments of a marker holster that overcome all of the prior shortcomings in an inexpensive, easy-to-use, sightless, marker holster, allowing for true one-handed operation.

Embodiments taught herein include: a universal holster that replaces a marker's own cap; a side opening with a flared top opening with wings that doubles (i) as a funneled guide so that the marker does not have to be exactly positioned for reinsertion, and (ii) as a surface upon which any number of fingers or a thumb of a hand can rest to provide opposite pressure for upward pulling; a clip to attach to a variety of surfaces; and an inner smaller marker tip compartment to seal the tip and prevent drying.

This has several advantages over the prior art. Firstly, embodiments of the device taught herein can accommodate almost any brand of marker and is brand blind. Second, embodiments of this design provide for a truly sightless, one-handed operation where the marker can 'miss' the opening slightly and still be guided into place. Third, embodiments of this device teach there is no need for the original marker cap so that it is not an issue if it is lost or dropped. Fourth, embodiments herein provide for a universal clip such that the marker can be deployed in almost any circumstance.

Additionally, in one embodiment, an integrated shield is provided that acts to prevent the marker from accidentally contacting and marking clothing to which the device is attached.

Additionally, in one embodiment, the clip can be removable and replaceable allowing various configurations of the clip to be utilized, each designed for various specific applications, for example and not by way of limitation, wide industrial belts, pockets, equipment, clothing, and the like.

None of the disclosed prior art references or other known prior art, alone or in combination, teach the salient and proprietary features of the present disclosure as just described.

SUMMARY

The present disclosure teaches embodiments of a marker holster design that provide a flared opening with a combined intuitive side opening and flanges that allow for easy marker re-insertion without having to exactly 'hit the target.' This disclosure also teaches embodiments of a marker holster design that provide for flanges that provide a pressure point to push off of when removing the marker, an internal small cavity compartment to prevent marker tip drying, and a universal clip.

DETAILED DESCRIPTION

Figure 1:
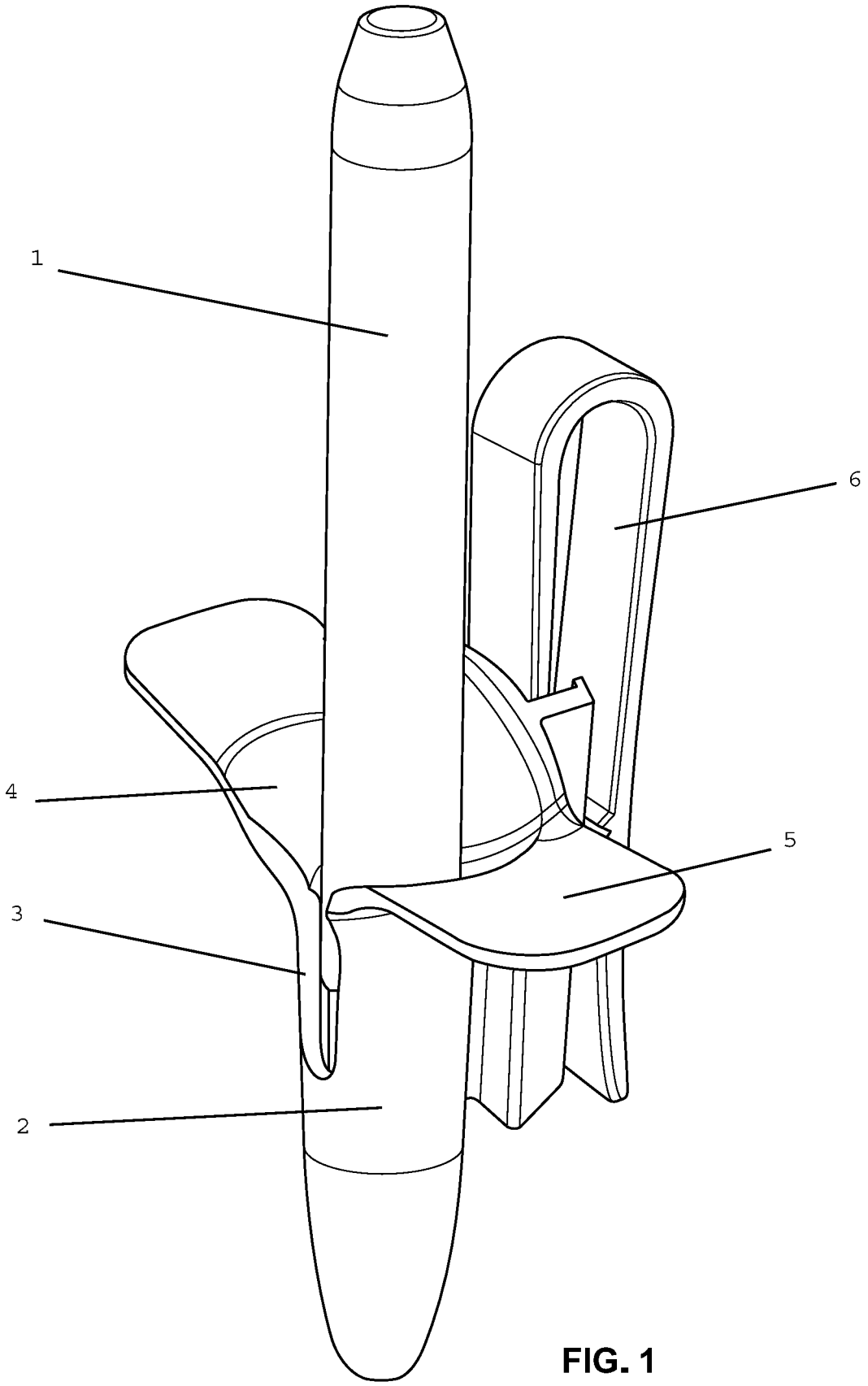
FIG. 1 depicts one embodiment of the present disclosure wherein a marker of any brand (1) is placed within a configuration of the device herein described (2), having a side opening (3), a flared top opening (4), flared wings off the top opening (5) and a clip (6) to hold onto some external apparatus such as a belt or pocket (not shown).
Figure 2:
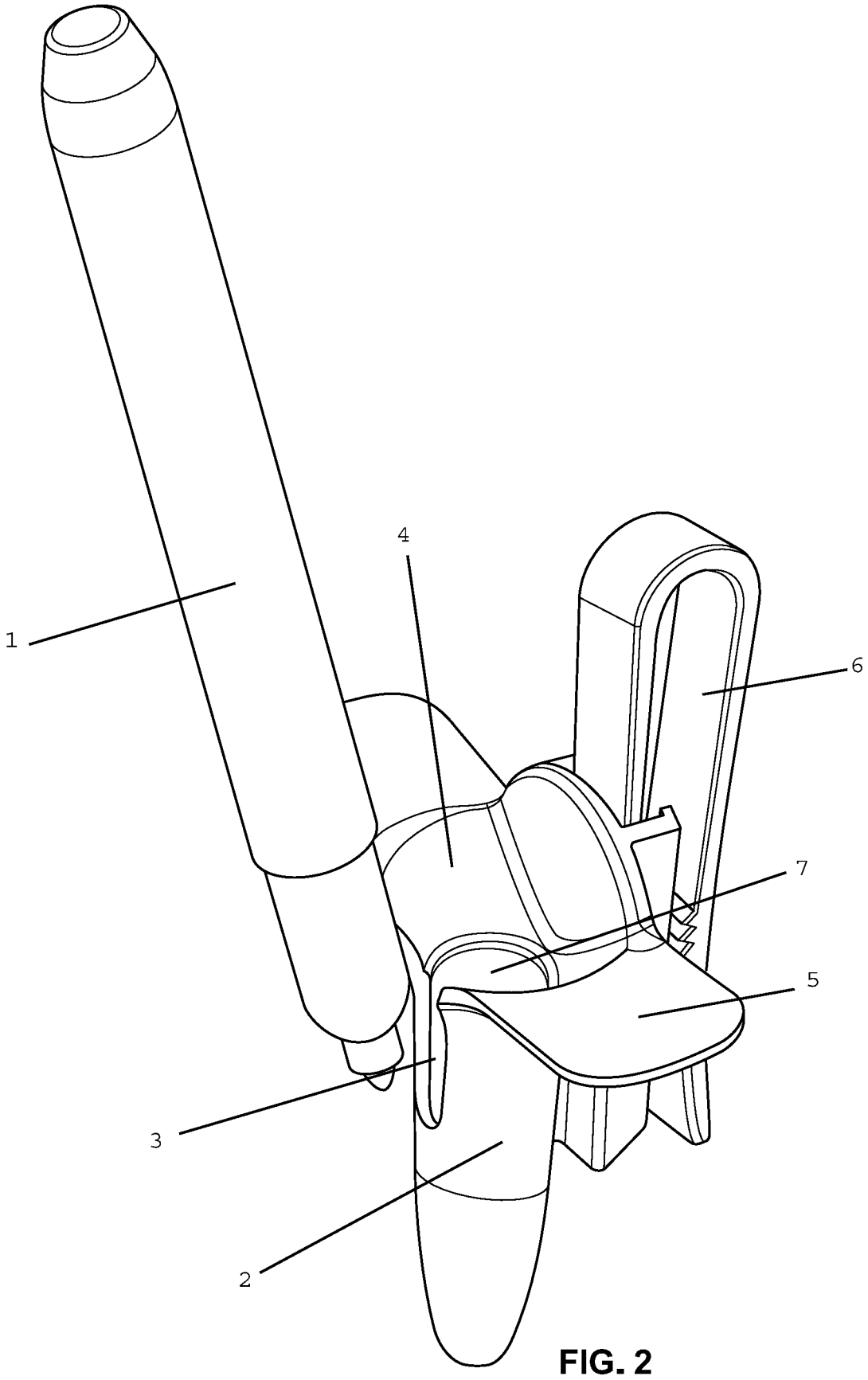
FIG. 2 depicts an embodiment of the present disclosure wherein a marker of any brand (1) outside of and ready to be placed within a configuration of the device herein described (2) having a side opening (3), a flared top opening (4), flared wings off the top opening (5), the top opening itself (7) and a clip (6) to hold onto some external apparatus such as a belt or pocket (not shown).
Figure 3:
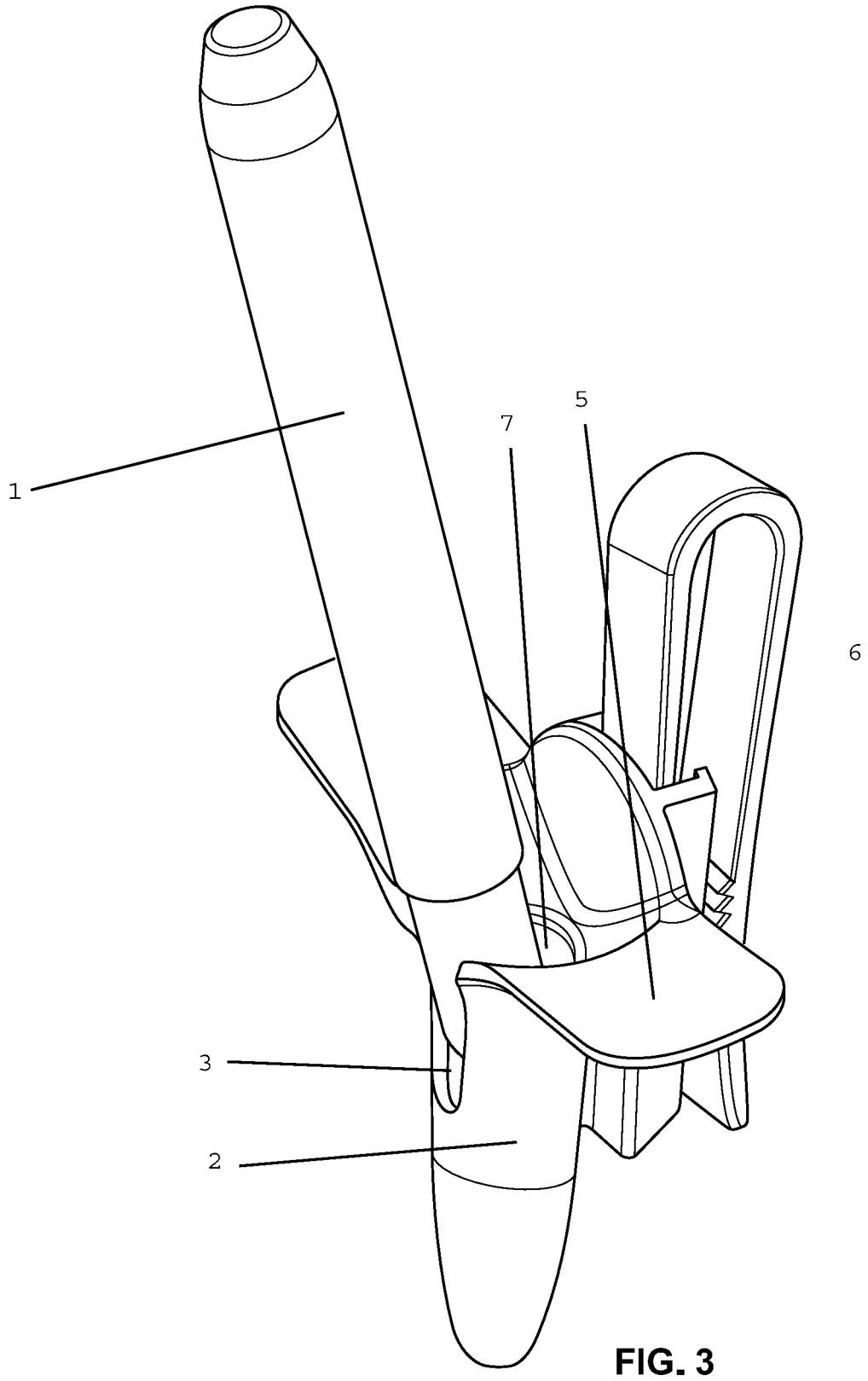
FIG. 3 depicts one embodiment of the present disclosure wherein a marker of any brand (1) as it is being guided by the design and placed within a configuration of the device herein described (2) having a side opening (3), a top opening (7), flared wings off the top opening (5) and a clip (6) to hold onto some external apparatus such as a belt or pocket (not shown).
Figure 4:
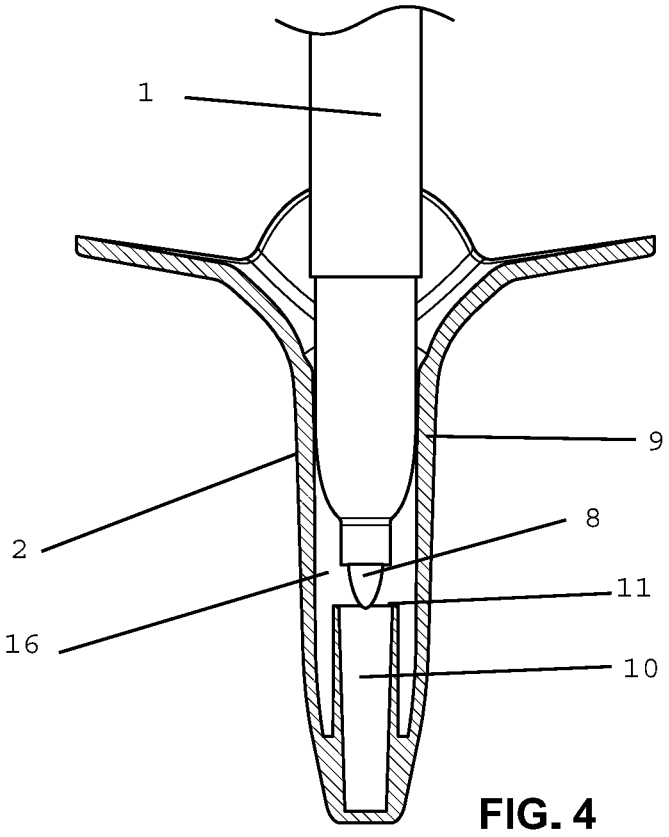
FIG. 4 depicts one embodiment of a side cutaway view of the present disclosure wherein a marker of any brand (1) fits into the cavity (16) when placed within a configuration of the device herein described (2) having an opening with inside sidewalls (9), an internal lower smaller tip cavity (10) with a top opening (11) into which a marker tip (8) fits snugly.
Figure 5:
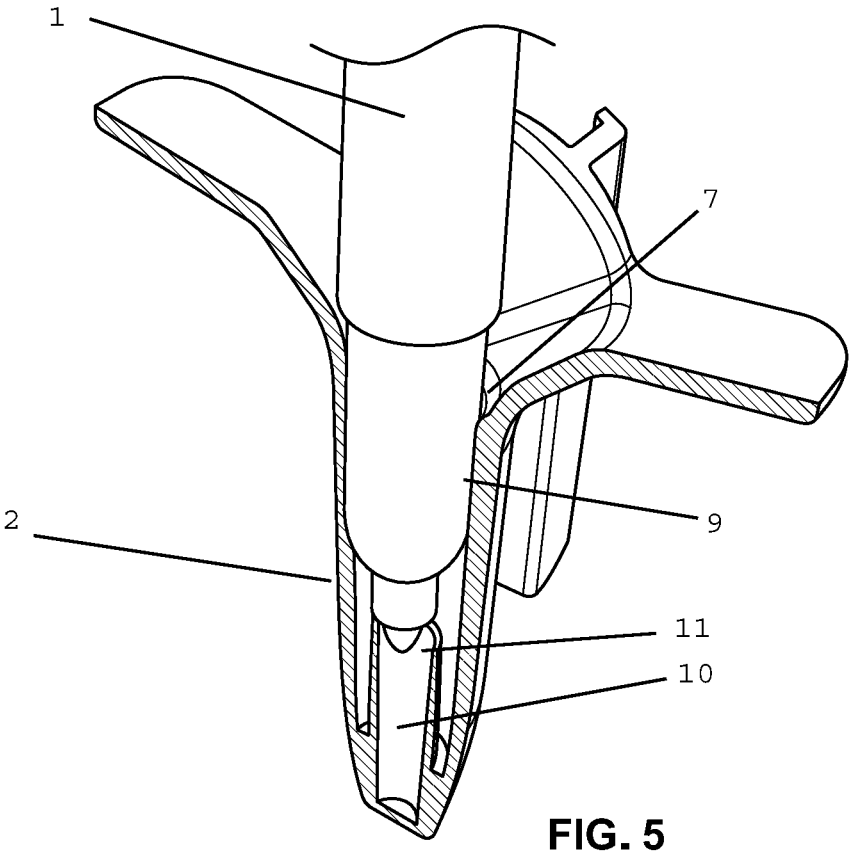
FIG. 5 depicts one embodiment of a perspective side cutaway view of the present disclosure wherein a marker of any brand (1) fits into the cavity when placed within a configuration of the device herein described (2) having a top opening (7) with inside sidewalls (9), an internal lower smaller tip cavity (10) with a top opening (11).
Figure 6:
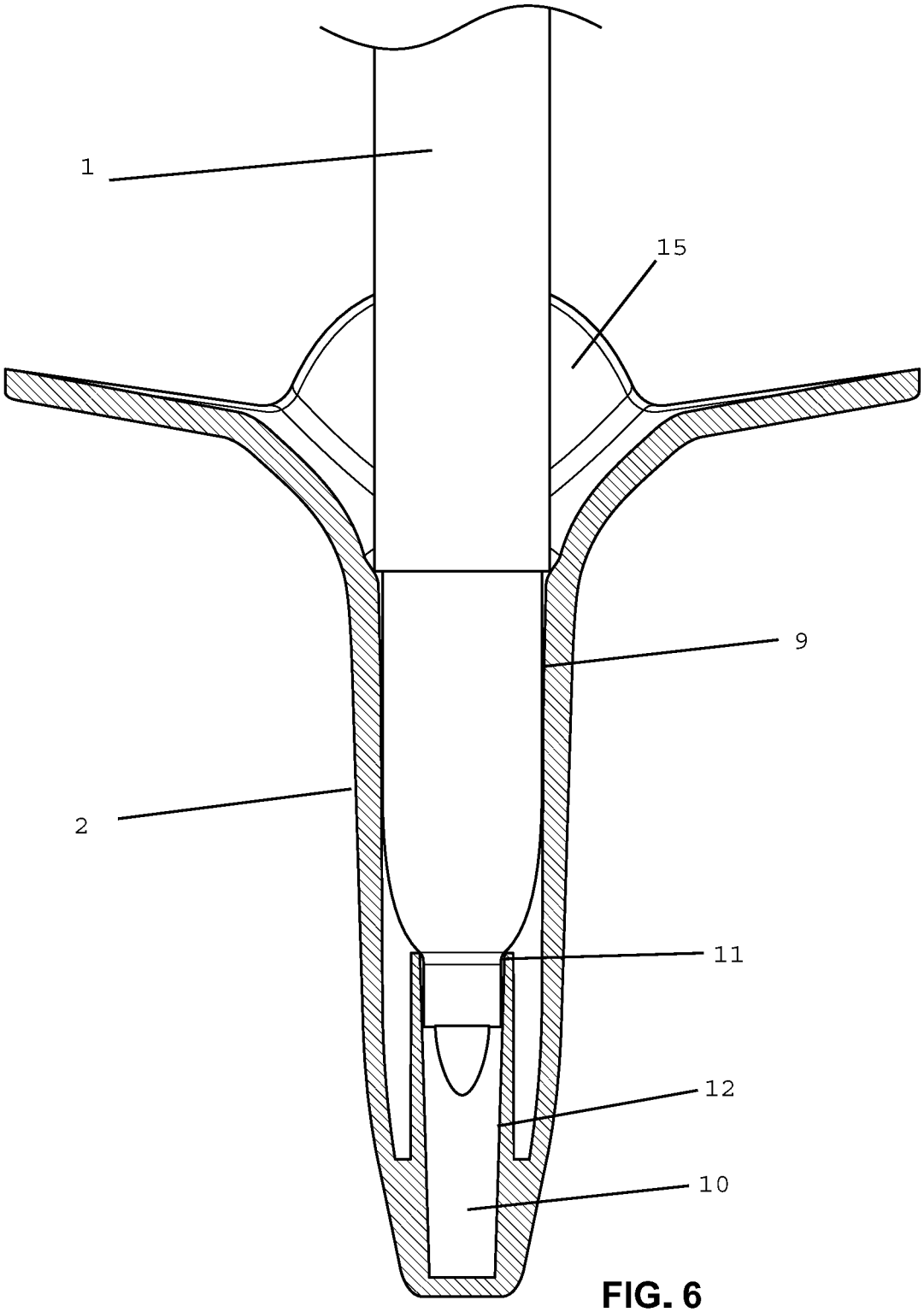
FIG. 6 depicts one embodiment of a side cutaway view of the present disclosure wherein a marker of any brand (1) is fit completely into the cavity when placed within a configuration of the device herein described (2) having an opening with inside sidewalls (9), an internal lower smaller tip cavity (10) with a top opening (11) and inside sidewalls (12). Additionally, in one embodiment, the marker holster provides an extended area (15) as a clothing protector such that when the marker is removed from the holster, it does not inadvertently mark the wearer's clothing.

For clarity of disclosure, and not by way of limitation, the detailed description of the invention is divided into the following subsections that describe or illustrate certain features, embodiments or applications of the present invention.

Definitions

"marker holster" as used herein means a device generally tubular in shape with an opening at one end and closed at its other end configured to house a general marker commonly used in the construction trades.

"inner small cavity" as used herein means a separate smaller cavity disposed within, at or near the closed end of a marker holster configured to receive the writing means of a general marker commonly used in the construction trades and seal it off from the rest of the inner area of the holster marker to reduce air flow around said writing means thereby preventing drying out of the marker.

"flange" as used herein means material disposed at or near the open end of a marker holster configured in an extended and/or flared manner to provide a surface against which a finger or thumb of one hand may push to exert opposite force when withdrawing a marker from a marker holster.

"side opening" as used herein means a slit or elongated absence of material beginning at the open end of a marker holster and continuing for a partial distance down the length of the marker holster tube toward the closed end, but only disposed along approximately one-quarter of the circumference of the marker holster tube.

"clip" as used herein means any suitable easy-on/easy-off attachment mechanism to secure a marker holster to another implement commonly present in a trades industry environment, such as, but not limited to, a belt, a tool belt, a ladder, a pail, and the like. It is flexible enough to attach to a wide variety of shapes and sizes and belt widths or pocket depths and may be removable and replaceable to allow for various configurations specific to various applications.

The System and Method of the Present Invention

In one embodiment, the present disclosure provides a marker holster comprising: a tubular implement having an opening at one end and a closed tip at its opposite end; a side opening disposed from the open end of the tubular implement; at least one flange disposed adjacent to and from the open end of the tubular implement; a smaller inner cavity disposed within and at or near the closed end of the tubular implement; and a clip.

In one embodiment, the marker holster comprises an opening at the top configured to receive a marker wherein the opening is flared at the top and tapering smaller as it descends to act as a funnel to guide the marker into its desired resting place. In this manner, the marker does not have to be exactly inserted—hitting anywhere near the opening will facilitate its insertion. In one embodiment, the marker holster further comprises a side opening that meets with the top opening and extends a portion of the way down the side of the marker holster further allowing the marker to slightly 'miss-the-mark' and still be guided into its desired resting place. This enables sightless re-insertion of the marker into the holster.

In one embodiment, the marker holster also comprises at least one flange extending from the top opening. In a desired configuration, the marker holster comprises two flanges, disposed opposite each other, one on each side of the top opening to provide places where fingers or thumbs can easily find the opening by feel and also to provide a place where the user can apply pressure in reverse in order to facilitate removal of the marker from its holster resting place. Again, the foregoing is all with sightless operation in mind—both insertion and removal.

In one embodiment, the marker holster further comprises an inner small cavity disposed within the overall cavity of the tubular marker holster, within which, the writing tip of a marker will rest when the marker is in its desired resting place. In this configuration, when the inner side walls of the overall cavity catch the marker and it is guided into its desired resting position, the writing tip of the marker is housed within this inner small cavity and creating a seal whereby it will not dry out due to air flow around it.

In one embodiment, the side opening has a secondary benefit. When removing the marker from its resting position, marker holsters without the side opening (all known such devices do not have this feature) require the user to lift the marker completely out of its resting place. While seemingly trivial, in actual use, where a tradesman is attempting this action without looking (often the case) and one-handed, it is easy for the tip of the marker to catch the lip of the opening and cause the marker to fall. This happening defeats the entire purpose of having a holster in the first place. By having the side opening, the user is guided and can slip the marker in and/or out tilting it into position for use and there is no opening lip for the marker tip to catch and hence, no unintended dropping of the marker.

In one embodiment, the marker holster further comprises a clip wherein on one portion of the clip, it attaches to the marker holster itself and on another portion of the clip, it is configured to attach to some other implement commonly present in the industry making the marker accessible to a user. Several non-limiting examples of such a place would be a user's belt, pocket or toolbelt. Additional non-limiting examples not related to the user, would be a ladder or a workbench.

In one embodiment, the marker holster further comprises an extended area of material opposite the side where the side opening is located and adjacent to the two opposite flanges which would make it the area adjacent to the clip and where the holster would be next to the wearer and the wearer's clothing. This added feature protects the wearer's clothing from getting marked when either taking the marker out of the holster or returning it to the holster.

Figure 7:
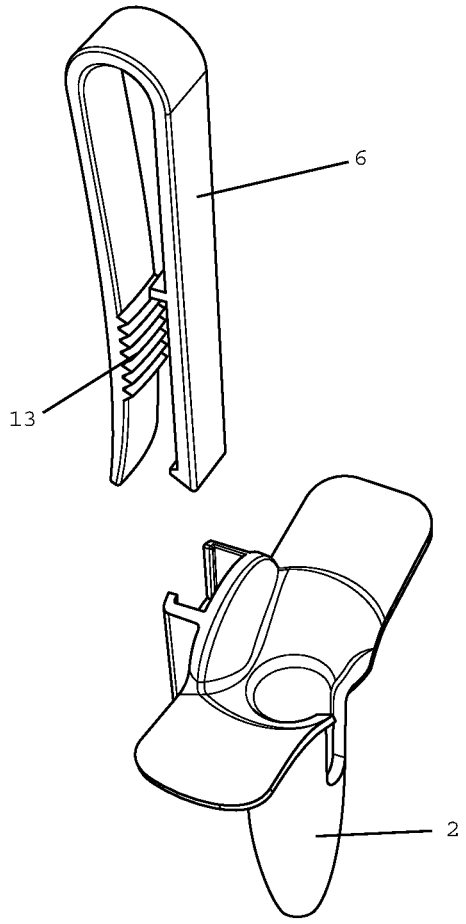
FIG. 7 depicts one embodiment of the general holster device as described herein (2) with one embodiment of a clip (6) removed to show the clip teeth (13) that provide friction to hold the clip attached to whatever object it is affixed.
Figure 8:
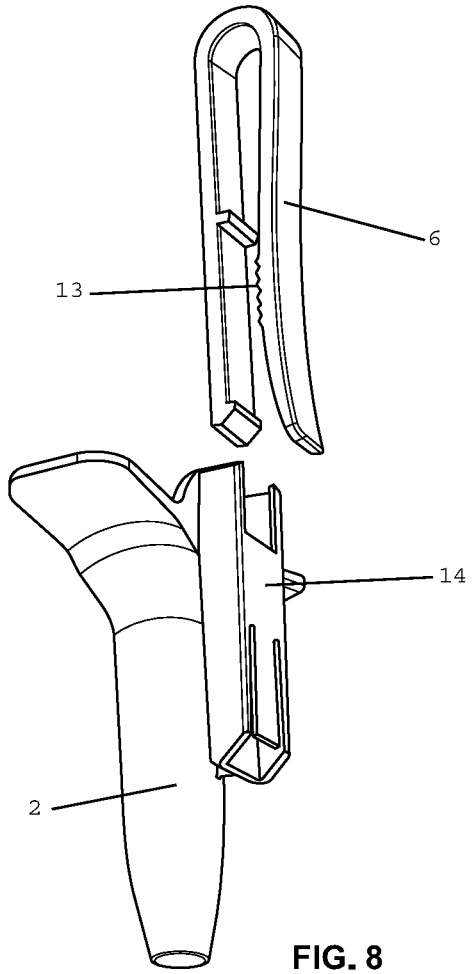
FIG. 8 depicts one embodiment of the general holster device as described herein (2) with one embodiment of a clip (6) removed from the clip insert (14) to show the clip teeth (13) that provide friction to hold the clip attached to whatever object it is affixed.

In one embodiment, the marker holster can comprise two pieces—the body of the holster and the clip (as shown in FIG. 7). In an alternative embodiment, the clip could be molded and formed together with the body and make one contiguous implement.

In one embodiment, where the holster and clip are two separate pieces, the clip and the holster can be made of dissimilar materials. In a non-limiting example, the clip could be made of a non-flexible or rigid material enhancing the strength and attachment properties of the clip, while the holster could be made of a flexible or semi-flexible material aiding the holster in accepting a variety of marker circumferences.

In one embodiment, any material used will not absorb alcohol which aids in marker ink retention and preventing drying out.

In one embodiment, because no marker cap is needed as the holster performs all of the functions of the original marker cap, the marker could be repackaged for use with the holster with a small, temporary cap just for shipping which is removed and discarded. This will provide a significant savings to marker manufacturers.

In one embodiment, the marker holster could be formed out of any suitable material that imparts desired properties, such as strength, low cost, ease of manufacture, low weight, easy to fix or replace, etc. One of skill in the art will easily identify appropriate materials. It is thought that materials of choice would include, plastic, polycarbonate, plexiglass, metal, metal alloys, and the like. In one embodiment, the chosen material is colorable and can be custom colored to coordinate with various color markers and/or coordinate with various brand colors.

In one embodiment, the material chosen will have a flexible/stiffness ratio allowing the marker holster to flex a desired amount—for example, for the side opening to open slightly on removal, but remaining stiff enough to keep a secure hold on the marker when inserted. Certain plastics and polycarbonate are examples of such a material.

In one embodiment, by having two flanges, one on either side, this allows for either right- or left-handed users to easily use their desired thumb in removing the marker.

In one embodiment, when the clip is removable, clips of various lengths may be implemented, or various positions of the clip within its attachment to the holster may be utilized, to provide for the holster to hang at different heights from a belt, pocket or other desired clip location.

EXAMPLES

The present invention is further illustrated, but not limited by, the following examples.

In one embodiment, a tiler installing tile in a kitchen or bathroom will have a need to cut tiles and to label tiles for a particular order of placement. The tiler in this situation will have a need for a marker to mark tiles for cutting at a certain spot and/or for placement. Typically, the tiler will handle a single tile with one hand and have a need to mark it with the other. It would simplify this procedure to have at the ready, a marker that the marking hand could easily grab, and replace, without the need for the tile holding hand to get involved, or without the need to see the marker.

In this embodiment, this tiler, using a marker holster as taught and described herein, would have sightless access with one hand to a marker whenever needed. Whether this tiler was right-handed or left-handed would not matter. Embodiments of the marker holster taught herein can be disposed on either side of the body or on some other external implement. A tiler, measuring tiles for cuts, having such a tile in one hand, could reach with the other hand and feel the end of a marker and know then, to feel for a flange and be able to then push against the flange and pull the marker up and sideways out of the holster then having the marker in the hand in a position ready for use. Once used, again without looking, the tiler would move the marker in the basic direction of where it came from and without needing to hit the mark exactly, would either find the opening, or even in the case where it was not readily obtainable, would be able to feel with other fingers for a flange, or a flared opening and then insert the marker, the marker holster then guiding the marker the rest of the way into position. The marker would remain there until next use, with the marker tip secure from drying out.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A marker holster, comprising:

a tubular implement having an opening at a first end and a closed tip at its second opposite end;

said tubular implement further comprising a side opening disposed along a defined length beginning at said opening at said first end;

said tubular implement further comprising at least two flanges disposed adjacent to and extending from the opening at said first open end;

said tubular implement further comprising a smaller inner cavity, generally tubular in shape, also having a first open end and a second opposite closed end, disposed within and at or near the closed end of the tubular implement; and a clip.

2. The marker holster of claim 1, wherein it is made from plastic.

3. The marker holster of claim 1, wherein it is made from a material of a specific color, chosen from the group: black, white, red, yellow, orange, green, purple, blue, brown, and gray.

4. The marker holster of claim 1, further comprising an extended area from the opening at the first end to act as a clothing protector.

5. The marker of claim 1, wherein it is made from a material that does not absorb alcohol.

6. The marker holster of claim 1, wherein all but the clip portion is made from a non-rigid material and the clip is made from a rigid material.

* * * * *